US009808088B2

(12) United States Patent
Scagnellato et al.

(10) Patent No.: US 9,808,088 B2
(45) Date of Patent: Nov. 7, 2017

(54) CHAIR WITH A FRAME WITH TUBULAR ELEMENTS

(71) Applicant: CERANTOLA S.P.A., Loria, Frazione Ramon (IT)

(72) Inventors: Paolo Scagnellato, Padua (IT); Jeremiah Ferrarese, Padua (IT)

(73) Assignee: CERANTOLA S.P.A., Loria, Frazione Ramon (IT)

( * ) Notice: Subject to any disclaimer, the term of this patent is extended or adjusted under 35 U.S.C. 154(b) by 0 days.

(21) Appl. No.: 14/782,412

(22) PCT Filed: Apr. 4, 2014

(86) PCT No.: PCT/IB2014/060435

§ 371 (c)(1),
(2) Date: Oct. 5, 2015

(87) PCT Pub. No.: WO2014/162295

PCT Pub. Date: Oct. 9, 2014

(65) Prior Publication Data

US 2016/0051053 A1 Feb. 25, 2016

(30) Foreign Application Priority Data

Apr. 5, 2013 (IT) ..... PD2013A0083

(51) Int. Cl.
*A47C 3/04* (2006.01)
*A47C 7/00* (2006.01)
*A47C 1/124* (2006.01)

(52) U.S. Cl.
CPC ..... *A47C 3/04* (2013.01); *A47C 1/124* (2013.01); *A47C 7/002* (2013.01)

(58) Field of Classification Search
CPC ..... A47C 3/04; A47C 1/124; A47C 7/002
USPC ..... 297/248, 239
See application file for complete search history.

(56) References Cited

U.S. PATENT DOCUMENTS

| | | | | |
|---|---|---|---|---|
| 3,084,977 | A * | 4/1963 | Chapman | A47C 1/124 297/239 |
| 3,610,686 | A | 10/1971 | Caruso | |
| 5,308,146 | A * | 5/1994 | Chou | A47C 3/04 297/118 |
| 6,866,338 | B2 * | 3/2005 | Mendenhall | A47C 1/124 16/18 CG |
| 2008/0277982 | A1 | 11/2008 | Bartlmae | |
| 2009/0079235 | A1 | 3/2009 | Huang | |
| 2010/0156156 | A1 | 6/2010 | Smith | |

OTHER PUBLICATIONS

International Search Report and Written Opinion dated May 27, 2014 issued in PCT/IB2014/060435.

* cited by examiner

*Primary Examiner* — Milton Nelson, Jr.
(74) *Attorney, Agent, or Firm* — Scully, Scott, Murphy & Presser, P.C.

(57) ABSTRACT

A chair with a frame with tubular elements, which comprises two inverted V-shaped elements that form the front legs and rear legs, are parallel and are joined substantially at their inner curvature to a rod-like crossmember, two L-shaped elements connected by the crossmember on which they are arranged in a parallel configuration so as to form a support for the back and for the seat, respectively with first substantially vertical portions thereof and second substantially horizontal portions.

6 Claims, 4 Drawing Sheets

CHAIR WITH A FRAME WITH TUBULAR ELEMENTS

The present invention relates to a chair with a frame with tubular elements.

Chairs with tubular elements, typically made of metal and constituted by two inverted U-shaped elements that form the legs, two L-shaped elements that form a support for the back and the seat and two horizontal and parallel rodlike crossmembers that join the two inverted U-shaped elements, are currently widespread.

The frame is designed so that the chair can be stacked easily for storage and transport in pallets.

The possibility of stacking is achieved by superimposing the chairs so that the inverted U-shaped elements of one chair are superimposed on those of the underlying chair.

However, since the elements are unlikely to be exactly mutually superimposed, this solution does not make it possible to achieve a stable stacking of the chairs.

Another drawback is due to the fact that the inverted U-shaped elements that constitute the legs of the chair for resting the frame on the ground, due to their very shape and due to the distance between the front legs and the rear legs, are unable to ensure stable resting also when the chair is in use, i.e., to exclude the risk of tipping, because the back typically protrudes from the rear part of the chair with respect to the rear legs.

Chairs with a frame with tubular elements are used widely in particular in waiting rooms of public and private offices and in conference halls, and therefore, since market demand is very high, the need is felt to reduce their transport costs and therefore also the weight and the volume occupied by the columns of stacked chairs, in order to maximize the number of chairs that can be transported within certain volumes.

Moreover, due to the widespread use of these chairs in waiting rooms, conference halls and the like, the need is also felt to be able to join the chairs laterally so as to create rows in which the chairs are mutually integral.

The aim of the present invention is to provide a chair with tubular elements that is capable of ensuring stability both in stacking and during use, excluding the risk of tipping, and that if necessary can be joined easily to the side of other chairs.

Within this aim, an object of the invention is to minimize the weight of the columns of stacked chairs to be transported.

This aim, as well as these and other objects that will become more apparent hereinafter, are achieved by a chair with a frame with tubular elements, characterized in that it comprises two inverted V-shaped elements that form the front legs and rear legs, are parallel and are joined substantially at their inner curvature to a rodlike crossmember, two L-shaped elements connected by said crossmember on which they are arranged in a parallel configuration so as to form a support for the back and for the seat, respectively with first substantially vertical portions thereof and second substantially horizontal portions, said chair being provided with means for locking vertical stacking with similar chairs.

Further characteristics and advantages of the invention will become more apparent from the description of a preferred but not exclusive embodiment of the chair according to the invention, illustrated by way of non-limiting example in the accompanying drawings, wherein.

Figure 1:
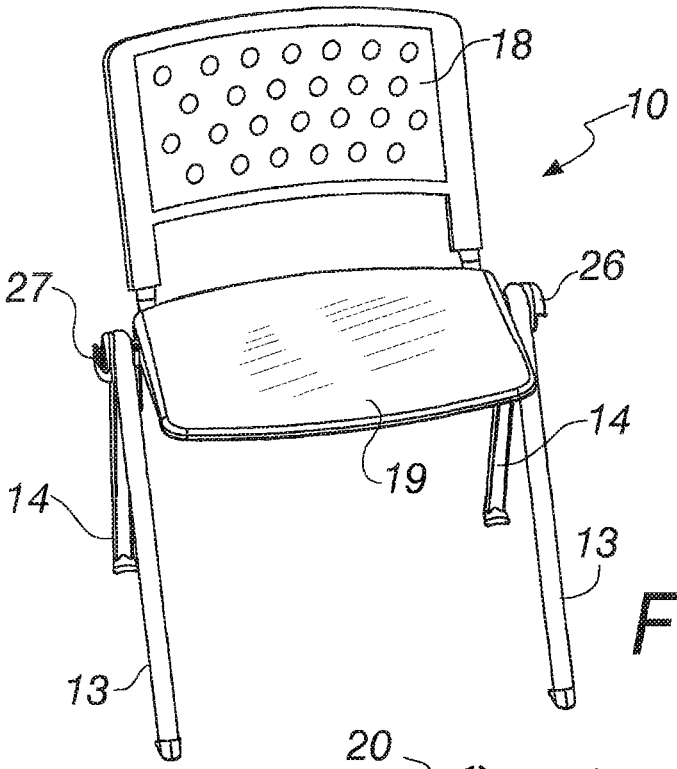
FIG. 1 is a perspective view of a chair according to the invention.

With reference to the cited figures, the chair according to the invention is generally designated by the reference numeral 10.

Figure 2:
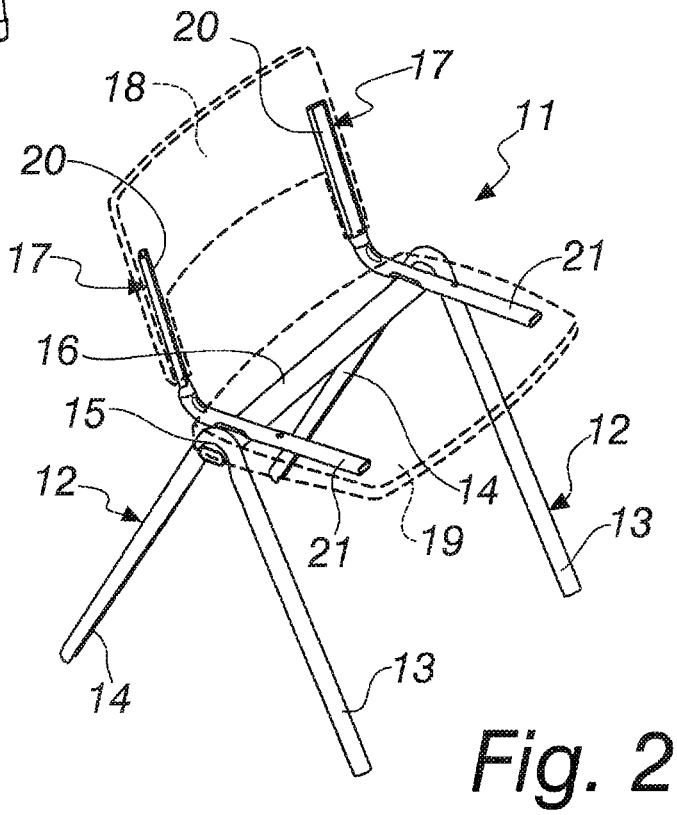
FIG. 2 is a perspective view of the frame of the chair according to the invention.

The chair has a frame 11 with tubular elements, shown individually in FIG. 2, which comprises two inverted V-shaped elements 12 that form the front legs 13 and rear legs 14 of the chair 10, are parallel and are joined substantially at their inner curvature 15 to a rodlike crossmember 16. The frame 11 comprises conveniently also two L-shaped elements 17 connected is by the crossmember 16 on which they are arranged in a parallel configuration so as to form a support for the back 18 and for the seat 19, respectively with their first substantially vertical portions 20 and second substantially horizontal portions 21.

It can be noticed that the two first portions 20 are slightly rotated advantageously inward, adapting to the curvature of the back 18 to be associated in order to compose the chair 10.

The front legs 13 and the rear legs 14 provide, with their resting points at the base, shown in FIG. 2, a resting area within which any point of the back 18 lies.

An angle of approximately 109° between the first portion 20 and the second portion 21 is in fact to be preferred, merely by way of example, for the inclination of the L-shaped elements 17.

Advantageously, the chair 10 is provided with means 24 for locking vertical stacking and with means 25 for lateral coupling with similar chairs 10.

Figure 9:
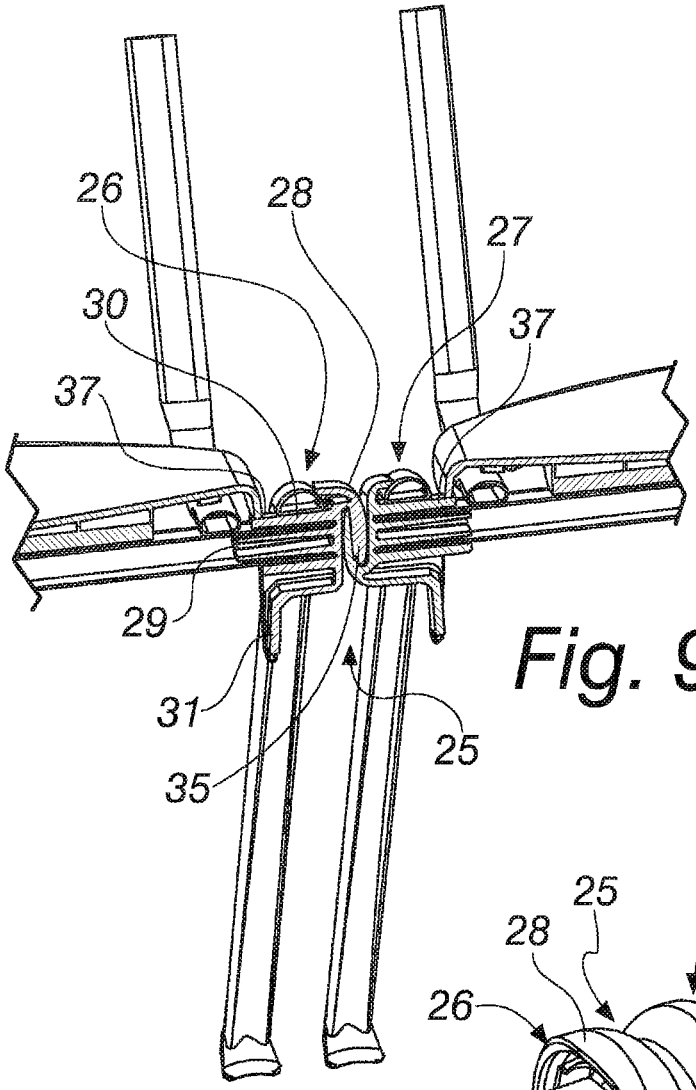
FIG. 9 is a sectional view, at the region of lateral joining of two chairs.

As shown in the subsequent figures, the chair 10 is provided with two plugs 26 and 27 made of plastic material, each of which has a head portion 28 and a stem 29 with which it closes the tubular element of the crossmember 16, entering a respective open end at the side of the chair 10. The stems 29 inserted at the sides of the crossmember 16 are clearly visible in the sectional view of FIG. 9, where they are used for the lateral coupling of two similar chairs 10.

The plugs 26 and 27 are not identical and can be identified as right plug 26 and left plug 27 so as to correspond to the two sides of the chair 10, for an observer who views it from the front part.

The two plugs, the right one 26 and the left one 27, are provided with some of the means 24 for locking vertical stacking.

Figure 5:
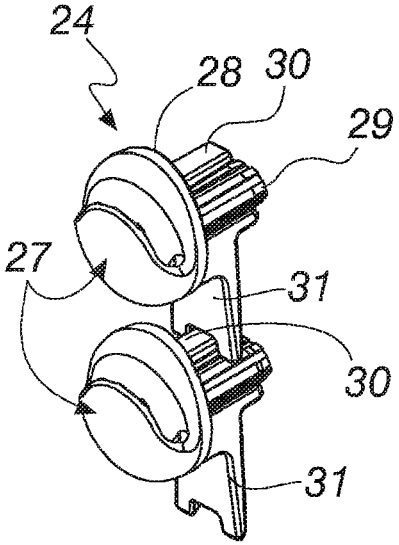
FIG. 5 is an enlarged-scale view of stacking means.
Figure 6:
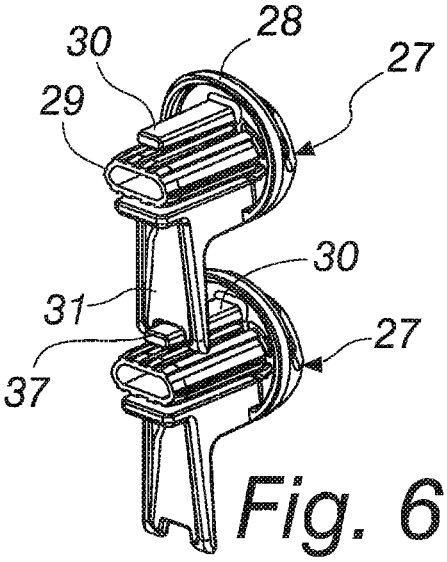
FIG. 6 is an enlarged-scale view, from the opposite side, of the same stacking means of FIG. 5.

In particular, as shown clearly in FIGS. 5 and 6, said locking means 24 comprise, for each of the plugs, the right one 26 and the left one 27, a is raised portion 30 that protrudes from the head portion 28 in the same direction as the stem 29 on the upper part of the crossmember 16 and a fork-like element 31, from the lower part of the crossmember 16, that is shaped complementary to the raised portion 30 and protrudes downward to mate with a raised portion 30 of the corresponding plug, the left one 27 in the illustrations provided, of a similar underlying chair 10.

More particularly, the raised portion 30, by protruding from the head portion 28 in the same direction as the stem 29, passes in a space comprised between the crossmember 16 and the inner curvature 15 of the V-shaped element 12, in order to protrude with an end portion 37 with which the fork-like element 31 is coupled.

Figure 7:
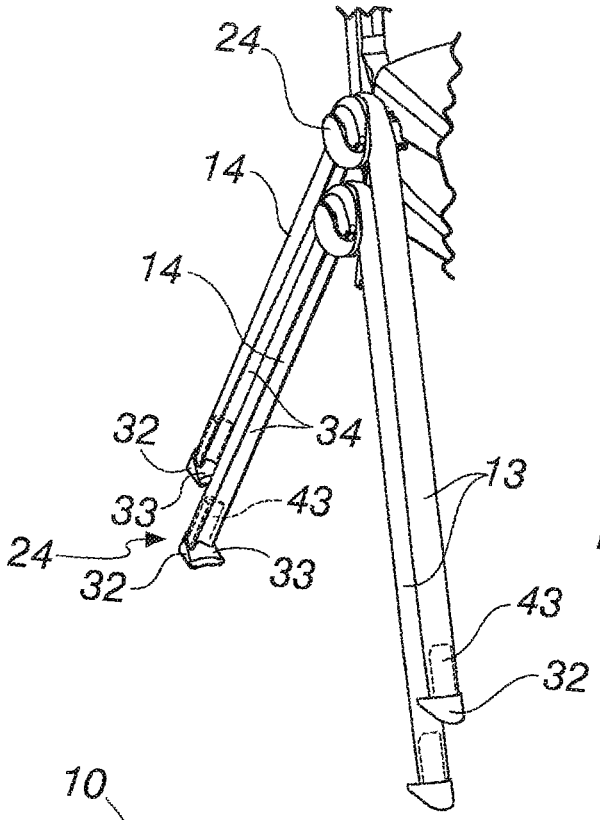
FIG. 7 is an enlarged-scale view of a portion of FIG. 3.

FIG. 7 is an enlarged-scale view of the superimposition of the legs of two chairs 10. In this figure and in others it can be seen that the chair 10 according to the invention is provided with four plugs 32 for resting on the floor, for closing the ends of the inverted V-shaped elements 12, i. e. of the front legs 13 and of the rear legs 14. The resting plugs 32 are preferably made of plastic material.

In particular, it can be noticed that they are provided with other locking means 24, which comprise a protrusion 33 from the inner part of the corresponding front leg 13 or rear leg 14, which is shaped substantially complementary to the curvature of the outer surface of the corresponding front leg 13 or rear leg 14 of a similar underlying chair 10.

More particularly, again in FIG. 7 it can be noticed that each one of the inverted V-shaped elements 12 has a reinforcement recess 34 on the inner side of each one of the two straight portions that form the front leg 13 and the rear leg 14. The resting plugs 32 are provided conveniently with a portion 43 (shown in broken lines) for insertion in the end portion of each front leg 13 or rear leg 14 that is shaped complementary thereto.

Figure 8:
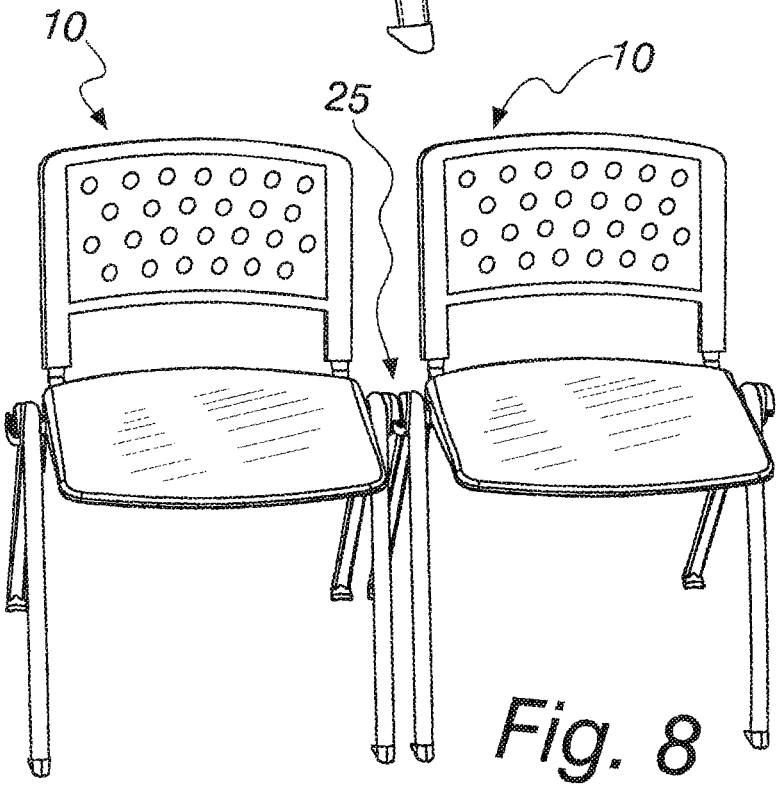
FIG. 8 is a perspective view of two chairs according to the invention joined laterally.
Figure 10:
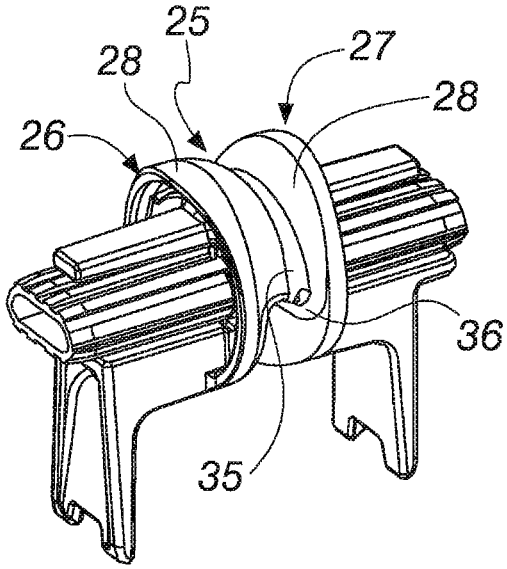
FIG. 10 is an enlarged-scale view of the lateral joining means.

FIG. 8 illustrates a pair of chairs 10 that are coupled laterally to two respective opposite sides. It can be seen in fact in the subsequent FIGS. 9 and 10 that the two plugs, both the right one 26 and the left one 27, are also advantageously provided with said means 25 for lateral coupling of one chair 10 with another similar chair.

Said means comprise a tab 35 that protrudes downward from the head portion 28 of one of the two plugs, the right one 26 in the illustrated case, in order to enter a cavity 36 that is open on the top and is provided on the upper part of the head portion 28 of the other one of the plugs, the left one 27, on the opposite side of a similar chair.

The two plugs 26 and 27 both have a tab 35, in one of which it protrudes upward so as to form the cavity 36 that is open on the top, while in the other one it protrudes downward, forming a cavity 36 that is open at the bottom.

The use of the chair according to the invention is as follows.

Figure 3:
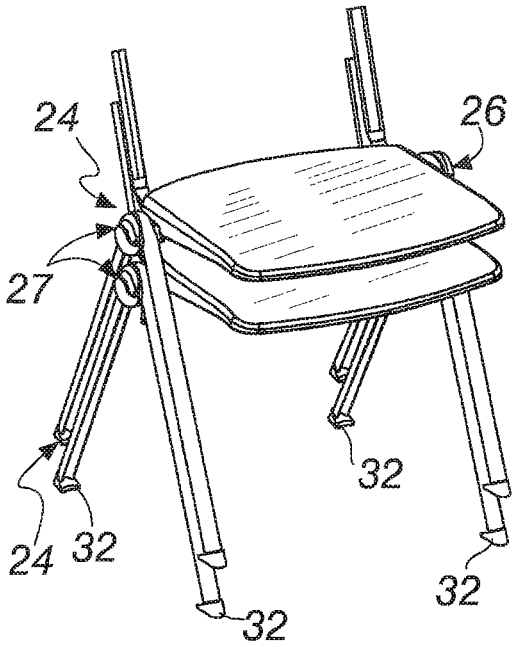
FIG. 3 is a perspective view of two chairs according to the invention, stacked and without a back.
Figure 4:
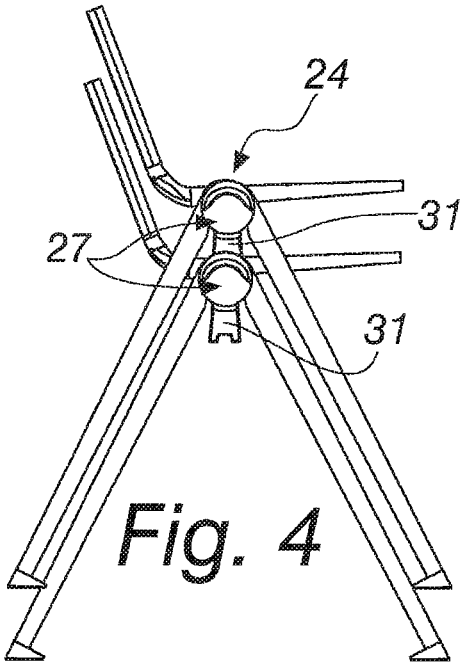
FIG. 4 is a side view of two chairs according to the invention, stacked and without the back and the seat.

When two or more similar chairs 10 are superimposed, according to the configuration shown in FIG. 3, the fork-like element 31 of one of the two plugs 26 or 27 mounted on the uppermost chair 10 engages the raised portion 30 of the corresponding plug, respectively 26 or 27, that is mounted on the underlying chair 10.

At the same time, the protrusion 33 of each one of the resting plugs 32 at the end of a respective front leg 13 or rear leg 14 rests on the outer surface, with respect to the curvature of which it is shaped complementary, of the corresponding leg 13 or 14 of the underlying chair 10.

The superimposition of course can be repeated for a varied number of chairs 10 to be stacked.

For the lateral coupling of two chairs 10, instead, one is moved closer to the other at two opposite respective sides, i. e. the right side of one to the left side of the other. For example, if in the example shown in FIG. 8 the right plug 26 is provided with a downward tab 35, the corresponding chair 10 is joined to a similar one on the opposite side of the latter, where a left plug 27 with an upward cavity 36 is fitted. The first of the two chairs 10 is raised slightly on the right side to enter with the tab 35 the cavity 36 of the left plug 27 of the second chair 10, as clearly shown in the sectional view of FIG. 9. This type of association evidently prevents the accidental spacing of the two chairs 10.

Like stacking, the lateral coupling of the chairs 10 can be repeated for a varied number of chairs 10, to be arranged side by side in order to form a row of the required length.

It should be noted that the means 24 for locking vertical stacking allow superimposition of the chairs 10 in a stable manner, since they are locked to each other by means of the coupling of the fork-like elements 31 to the raised portions 30, particularly with the end portions 37 (a solution that does not allow the uppermost chair to move forward and backward with respect to the lower one), and are kept in axial alignment by the resting plugs 32, with their protrusions 33 shaped complementary to the outer surface of the legs of the underlying chair.

It should also be noted that the curved shape of the back 18 makes it possible to contain the space occupation of the single chair and of a stack of chairs.

Moreover, it should be noted that the use of a frame of the described type makes it possible to reduce considerably the overall weight of the chair, thanks to the use of a single crossmember, and to mount a back 18 with such an inclination that any point thereof lies within the resting area, ensuring stability and tipping-resistant conditions for the chair 10.

In practice it has been found that the invention achieves the intended aim and objects, providing a chair that is capable of ensuring stability both in stacking and during use, excluding the risk of tipping, and that also can be joined easily and stably to the side of the other chairs.

Another advantage that arises from the possibility of stacking the chairs stably is to solve stability problems also during transport of the chairs, optionally on specifically provided pallets.

Furthermore, since the overall weight of each chair is reduced with respect to known chairs, thanks to a lightening of the frame, the weight of columns of chairs is also reduced in a more evident manner.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to the requirements and the state of the art.

The disclosures in Italian Patent Application no. PD2013A000083, from which this application claims priority, are incorporated herein by reference.

The invention claimed is:

1. A chair with a frame with tubular elements, comprising two inverted V-shaped elements that form front legs and rear legs, are parallel and are joined substantially at an inner curvature to a tubular crossmember, two L-shaped elements connected by said crossmember on which they are arranged in a parallel configuration so as to form a support for a back and for a seat, respectively with first substantially vertical portions thereof and second substantially horizontal portions, said chair being provided with a first locking means for vertical stacking with similar chairs, wherein the chair is provided with two plugs, each having a head portion and a stem by means of which it closes each of a first end of the tubular crossmember and a second end of the tubular crossmember, entering a respective open end at the side of the chair.

2. The chair according to claim 1, wherein the chair is provided with lateral coupling means for lateral coupling with similar chairs.

3. The chair according to claim 1, wherein said plugs are provided with said lateral coupling means, which comprise a tab that protrudes downward from said head portion of one of the two plugs, in order to enter a cavity that is open at a top and is provided on an upper part of the head portion of the other one of said plugs, on an opposite side of a similar chair.

4. The chair according to claim 1, wherein said plugs are provided with the first locking means, which comprises, for each one of the plugs, a raised portion that protrudes from said head portion in the same direction as said stem on the upper part of said crossmember, and a forked element, on the lower part of said crossmember, which is shaped complementary to said raised portion and protrudes downward in order to be coupled with a raised portion of the corresponding plug of a similar underlying chair.

5. The chair according to claim 4, wherein said raised portion, by protruding from said head portion in the same direction as said stem, passes within a space comprised between said crossmember and the inner curvature of said inverted V-shaped element, in order to protrude with an end portion with which said forked element is coupled.

6. A chair with a frame with tubular elements, comprising two inverted V-shaped elements that form front legs and rear legs, are parallel and are joined substantially at an inner curvature to a tubular crossmember, two L-shaped elements connected by said crossmember on which they are arranged in a parallel configuration so as to form a support for a back and for a seat, respectively with first substantially vertical portions thereof and second substantially horizontal portions, said chair being provided with a first locking means for vertical stacking with similar chairs, wherein the chair is provided with four resting plugs for resting on the floor, for closing the ends of said inverted V-shaped elements, of said front legs and of said rear legs, each one of said resting plugs being provided with a second locking means, which comprises a protrusion from the inner part of the corresponding front leg or rear leg, which is shaped substantially complementary to the curvature of the outer surface of the corresponding front leg or rear leg of a similar underlying chair, wherein each one of said inverted V-shaped elements has a reinforcement recess on an inner side of each one of two straight portions that form the front leg and the rear leg, said resting plugs being provided with a portion for insertion in the end portion of each front leg or rear leg that is shaped complementary thereto.

* * * * *